US005530988A

United States Patent [19]

McQuillan

[11] Patent Number: 5,530,988

[45] Date of Patent: Jul. 2, 1996

[54] DEVICE FOR CLEARING PIPES OR OTHER LINES WITH PRESSURIZED GAS

[76] Inventor: Raymond McQuillan, 140 Cedar Ave., Rockville Centre, N.Y. 11570

[21] Appl. No.: 280,789

[22] Filed: Jul. 26, 1994

Related U.S. Application Data

[63] Continuation-in-part of Ser. No. 902,294, Jun. 19, 1992, Pat. No. Des. 361,371.

[51] Int. Cl.[6] ..... A47L 9/00

[52] U.S. Cl. ..... 15/406; 4/255.06

[58] Field of Search ..... 15/406; 4/255.04, 4/255.06

[56] References Cited

U.S. PATENT DOCUMENTS

| | | | |
|---|---|---|---|
| 1,994,526 | 3/1935 | McCloskey | 4/255.06 |
| 2,056,018 | 9/1936 | Popp | 15/406 |
| 2,388,836 | 11/1945 | Dunn . | |
| 3,820,552 | 6/1974 | Lang et al. . | |
| 4,036,182 | 7/1977 | Gandy . | |
| 4,063,317 | 12/1977 | Santore | 15/406 X |
| 4,081,930 | 4/1978 | Jones . | |
| 4,429,665 | 2/1984 | Brown . | |
| 4,551,041 | 11/1985 | Coon et al. . | |
| 4,671,230 | 6/1987 | Turnipseed . | |
| 4,784,170 | 11/1988 | Romanelli et al. . | |
| 4,874,002 | 10/1989 | Sundholm . | |
| 5,022,364 | 6/1991 | Phillips . | |
| 5,085,244 | 2/1992 | Funk . | |
| 5,086,949 | 2/1992 | Vulpitta et al. . | |
| 5,097,806 | 3/1992 | Vataru et al. . | |
| 5,127,129 | 7/1992 | Frank et al. | 4/255.06 X |
| 5,127,961 | 7/1992 | Aiton . | |
| 5,416,947 | 5/1995 | Jaffe | 15/406 X |

OTHER PUBLICATIONS

Fuel Oil News, p. 37, Oct. 1992.

New Product News, Invention World Corp., Jul. 1992 (approx. date).

New Product News, Fuel Oil News, Aug. 1992.

*Primary Examiner*—Chris K. Moore

*Attorney, Agent, or Firm*—Ostrolenk, Faber, Gerb & Soffen

[57] ABSTRACT

A device for unclogging pipes or other lines. The device includes a canister adapted to receive a pressurized gas, the canister having at a first end a first valve adapted to be coupled to the pipe or line that is to be unclogged. The canister has at a second end a closure element, the closure element having a second valve attached thereto, the second valve adapted to connect to a source of pressurized gas. The canister further has a pressure gauge coupled thereto for indicating the pressure in the canister. The pressurized gas is fed into the canister through the second valve, and pressurized gas in the canister is fed to the pipe or line to be unclogged by means of the first valve. A method and device for providing an additive, such as a cleaning product, to a tank or line is also disclosed.

4 Claims, 3 Drawing Sheets

DEVICE FOR CLEARING PIPES OR OTHER LINES WITH PRESSURIZED GAS

CROSS REFERENCE TO RELATED APPLICATION

This application is a Continuation-in-Part of application Ser. No. 07/902,294 filed Jun. 19, 1992 and now U.S. Pat. No. Des. 361,371 issued Aug. 15, 1995, in the name of the applicant herein.

BACKGROUND OF THE INVENTION

The present invention relates to a device for using pressurized gas to clear pipes or other lines which have been clogged by a restriction. For example, the present invention is useful for clearing oil lines between an oil tank and an oil burner which have become clogged with dirt or sludge.

SUMMARY OF THE INVENTION

It is an object of the present invention to provide a device and method which can be used to clean clogged pipes or other lines.

A further object of the present invention is to provide a device and method for cleaning pipes or other lines using a pressurized gas.

It is yet still a further object of the present invention to provide such a device which is economical to use and to manufacture and convenient to use.

It is yet still a further object of the present invention to provide such a device which can be used with conventionally available gas cartridges, for example, $CO_2$ cartridges.

It is yet still another object of the invention to provide a device and method which can be used to provide additives into lines or tanks, e.g., into fuel tanks.

The above and other objects of the present invention are achieved by a device for unclogging a pipe or other line comprising a canister, the canister adapted to receive a pressurized gas, the canister having a first valve adapted to be coupled to the pipe or line that is to be unclogged; the canister having a second valve attached thereto, the second valve being adapted to connect to a source of pressurized gas; the canister having a pressure gauge coupled thereto for indicating the pressure in the canister; whereby pressurized gas may be fed into said canister through said second valve, and pressurized gas in said canister can be fed to the pipe or line to be unclogged through said first valve.

The above and other objects are furthermore achieved by a method for providing an additive to a line or tank containing a liquid., such as fuel, comprising filling a canister with the additive; closing the canister; coupling the canister to a line leading to the line or tank through a first valve; connecting a source of pressurized gas through a second valve to the canister; opening the second valve to pressurize the canister; and opening the first valve to force the additive through the line into the line or tank.

The objects of the invention are also achieved by a device for providing an additive to a line or tank containing a liquid, such as fuel, comprising a canister for receiving the additive; a first valve for coupling the canister to a line leading to the line or tank; and a second valve coupled to the canister adapted to connect the canister to a source of pressurized gas.

BRIEF DESCRIPTION OF THE DRAWING(S)

The invention will now be described in greater detail in the following detailed description with reference to the drawings in which.

DETAILED DESCRIPTION OF THE INVENTION

Figure 1:
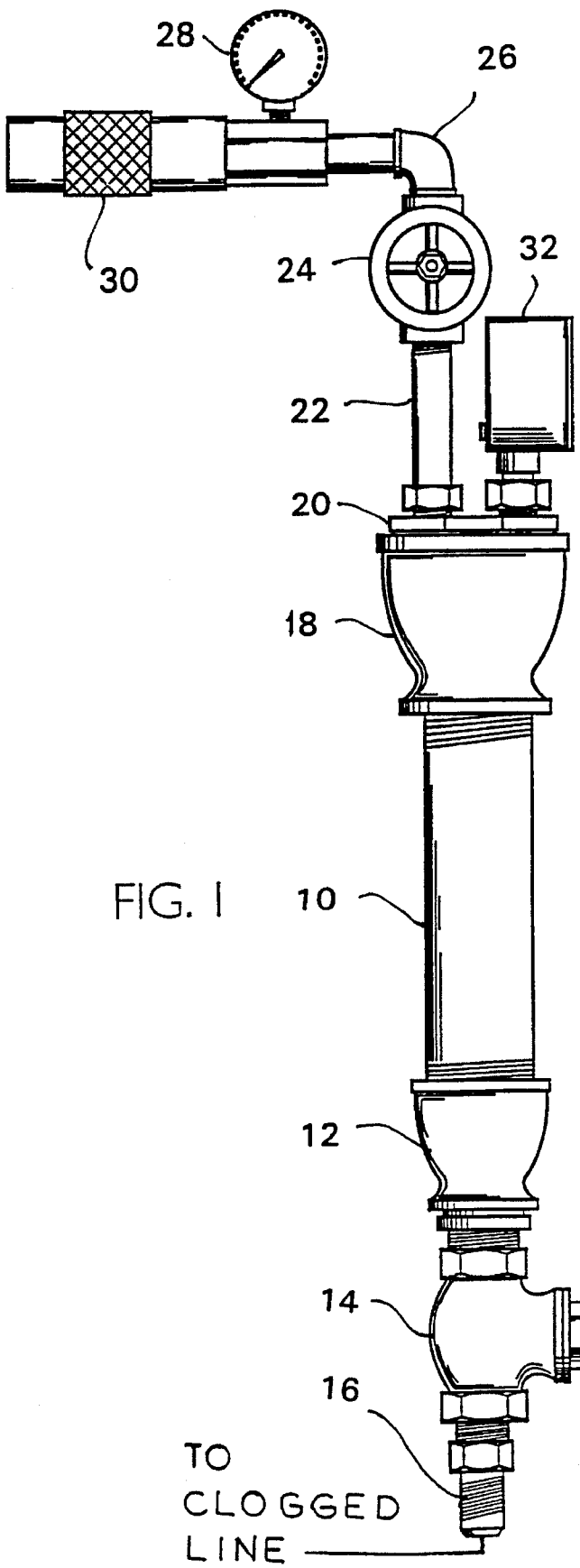
FIG. 1 shows a side view of one embodiment of the pressure clearing device according to the present invention.
Figure 2:
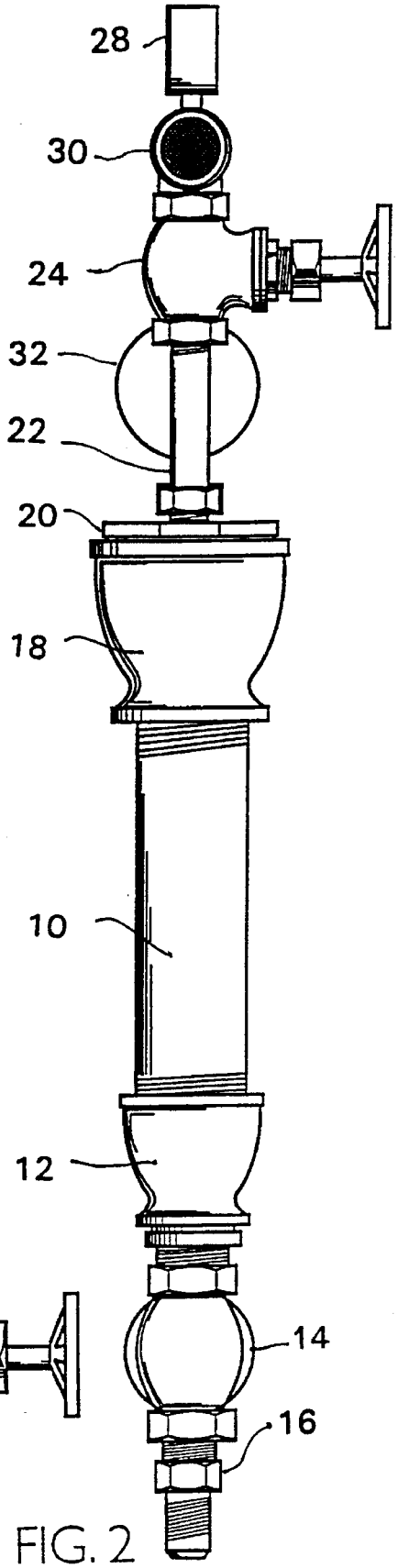
FIG. 2 shows a left side view of the device of FIG. 1.
Figure 3:
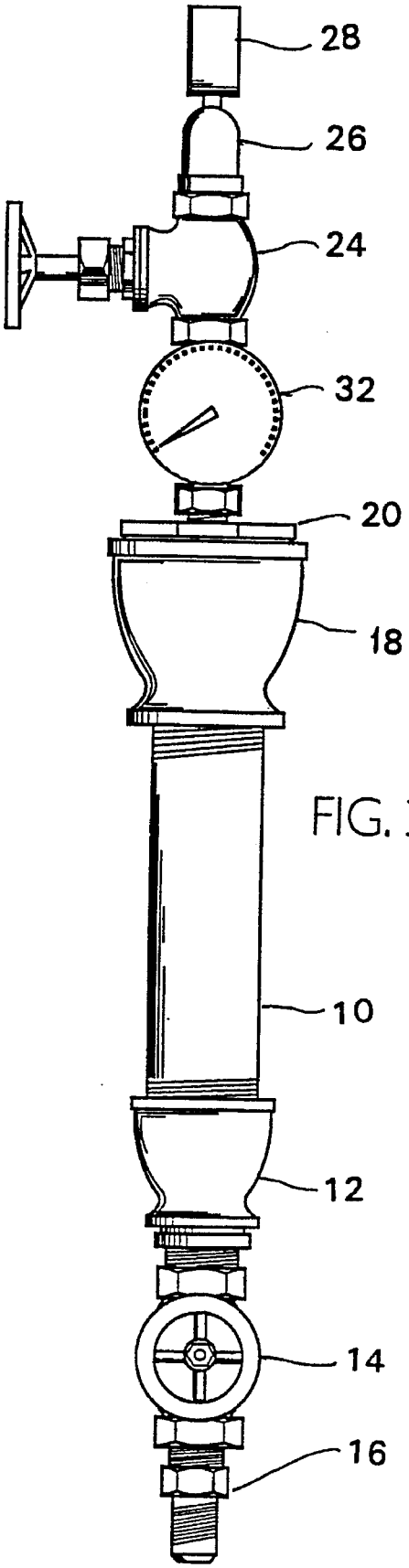
FIG. 3 shows a right side view of the device according to FIG. 1.
Figure 4:
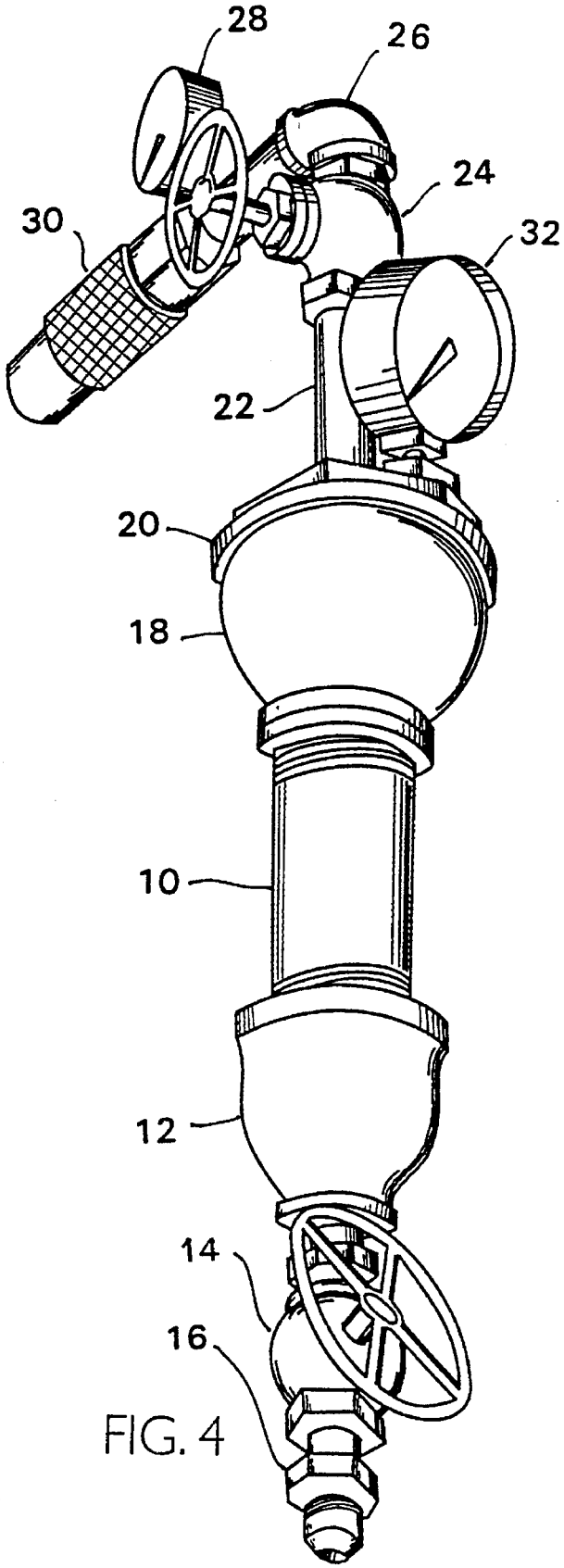
FIG. 4 shows a perspective view of the device according to the present invention.

With reference now to the drawings, a device for the pressurized clearing of clogged pipes or other lines is shown therein. The device comprises a tubular canister 10, which may be made from, for example, a length of steel, aluminum or brass pipe (or any other suitable material capable of withstanding pressure from a pressurized gas canister), for example, 1½" to 2 I.D. pipe. At a lower end, the pipe 10 is coupled to a reducer 12 and than to a valve 14. The valve 14 is provided with a suitable pipe fitting 16 for coupling to a pipeline that is clogged. At the other end, the pipe 10 is received into an expander 18. The expander has a pipe plug 20 screwed thereto which has two openings therein. Into one opening, a pipe 22 is provided, having a valve 24 attached thereto, suitable additional pipe 26 and a pressure indicator gauge 28. A suitable connector 30 is provided for receiving a pressurized gas canister, for example, a $CO_2$ cartridge. Into the other hole of the pipe plug 20, another pressure indicator gauge 32 is provided.

The device operates as follows:

When pipes or other lines, for example an oil line between an oil tank and oil burner, are clogged with dirt or sludge, the heating system will not work, and the lines must be cleaned. The device according to the invention provides a simple and easy way to clean lines. Access to the interior of the canister 10 may be obtained by unscrewing the pipe plug 20 or the expander/reducer 18 from the pipe canister 10. Into the canister 10, cleaning solutions or detergents to assist cleaning may be poured, for example, kerosene or other chemicals may be poured into the canister 10. This is only an option and it is not necessary to do this, but it may aid in the cleaning process. Pipe plug or reducer 18 is then screwed back on to close up the canister 10. With valves 24 and 14 closed, the $CO_2$ cartridge is then attached to the fitting 30. The valve 24 is then opened, allowing pressure to enter the canister 10, which will be indicated on the gauge 32. When the pressure in the canister is sufficiently high, e.g., 150 psi, the valve 14 is then opened and the pressurized gas and any optional chemicals, kerosene or other cleaning liquid in the canister 10, will then be forced into the clogged line or pipe, clearing it. The cleaning action is accomplished primarily by the pressurized gas, with the cleaning chemicals aiding the cleaning process. The user will know when the line is cleared because the pressure indicated on the gauge 32 will decrease. If the pressure does not decrease, then the user will know the pipe is still clogged.

Figure 5:
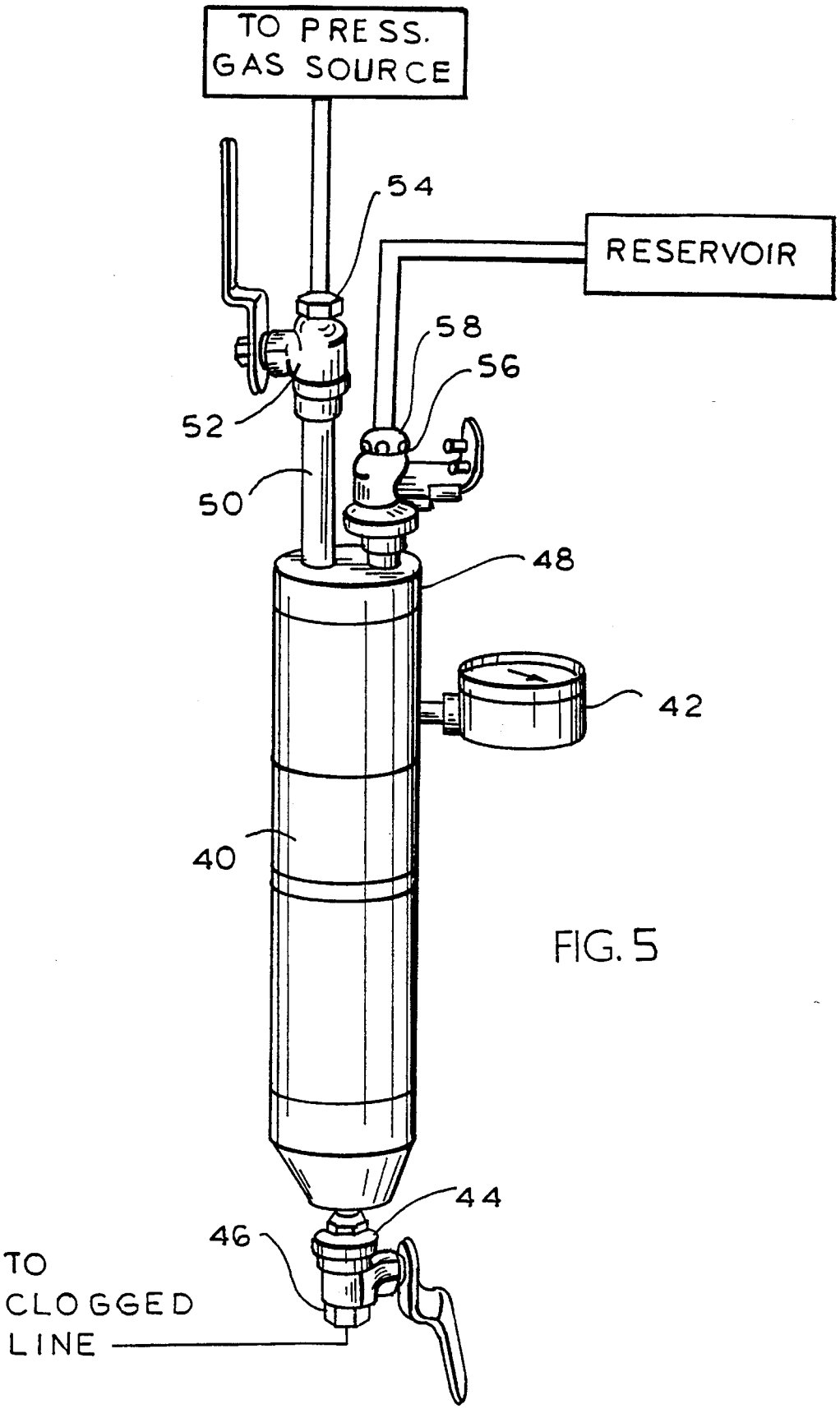
FIG. 5 shows a front view of an alternative embodiment of the present invention.

FIG. 5 shows an alternative embodiment of the invention which provides a means for releasing the pressure in the canister 10 if the clog in the pipe or line does not clear. In FIG. 5, the device is made from a turned aluminum canister instead of a section of pipe. The device includes a canister 40 having a gauge 42 screwed into a side thereof. Canister 40 may be made, for example, from turned aluminum stock capable of holding the pressure provided by a pressurized gas canister. At one lower end, the canister 40 tapers and is connected to a suitable valve 44, e.g., a ball valve, which has a pipe fitting at the end 46 thereof for connection to a pipe or other line to be unclogged. At the other end, the canister 40 is coupled to a suitable turned plug 48 having two holes therein. Into one of the holes, a section of pipe 50 is inserted which is coupled to a valve 52, e.g., a ball valve. The valve 52 has a suitable opening 54 for connection to a pressurized gas canister, for example, a $CO_2$ cartridge. Into the other opening of the plug 48, another valve 56, e.g., a ball valve, is provided. This valve 56 has a suitable pipe connection 58 which can be coupled to a collection reservoir or vented to the atmosphere.

This device operates as follows:

Prior to using the device, the plug fitting 48 may be unscrewed from the canister 40. Chemicals or cleaning liquids can then optionally be poured into the open canister 40. The plug 48 is then screwed back onto the canister 40, and with all valves 44, 52 and 56 closed, a suitable pressurized gas canister can be attached to the pipe fitting 54. The valve 52 is then opened, pressurizing the canister 40. In order to unclog the clogged line, which has been connected to the pipe fitting 46, the valve 44 is then opened, allowing the pressurized gas to enter the pipe or line, thereby unclogging the clog or constriction in the line.

The user will know that the pipe or line has been unclogged because the pressure indicated by the gauge 42 will have been reduced. In the event that the restriction is not unclogged, and high pressure remains in the canister 40, the contents of the canister 40 and the gas in the pipe or line can be removed by connecting a suitable reservoir to the pipe fitting 58 and opening the valve 56. Sometimes the device can be left connected to the clogged line for a period of time under pressure, and the clogged line may unclog after a period of time elapses.

Another use of the invention is that it allows the addition of fuel additives into fuel tanks without the necessity of actually finding the fuel tank fill caps, which are frequently difficult to find in the winter time when they may have been covered by snow or ice. In such a case, the device of the present invention can be used to force the fuel additive back into the fuel tank from the exit or burner end. The user simply has to locate the exit fuel line from the fuel tank and open that line, which is usually indoors, connect the device of the invention and use the pressurized gas to force the fuel additives into the fuel tank.

Although the present invention has been described in relation to particular embodiments thereof, many other variations and modifications and other uses will become apparent to those skilled in the art. Therefore, the present invention should be limited not by the specific disclosure herein, but only by the appended claims.

What is claimed is:

1. A device for unclogging a pipe or other line comprising:

a canister, the canister adapted to receive a pressurized gas, the canister having a first valve adapted to be coupled to the pipe or line that is to be unclogged;

the canister having a second valve attached thereto, the second valve being adapted to connect to a source of pressurized gas;

the canister having a pressure gauge coupled thereto for indicating the pressure in the canister;

whereby pressurized gas may be fed into said canister through said second valve, and pressurized gas in said canister can be fed to the pipe or line to be unclogged through said first valve; and further comprising a third valve coupled to said canister, said third valve being adapted to relieve pressure in said canister if the pipe or line fails to become unclogged by said pressure in the canister; and a collection reservoir coupled to the third valve for collecting the contents of the canister.

2. The device recited in claim 1, wherein the first valve is at a first end of the canister and the second valve is at a second end of the canister and coupled to a closure element for the second end of the canister.

3. The device recited in claim 1, further comprising an additional pressure gauge coupled to said second valve for indicating the pressure in a source of pressurized gas coupled to said second valve.

4. The device recited in claim 1, further wherein the third valve relieves pressure in the pipe or line and the reservoir collects the contents of the pipe or line.

* * * * *